United States Patent [19]

Borchardt et al

[11] Patent Number: 4,922,588

[45] Date of Patent: May 8, 1990

[54] SINGLE HINGE INTERLOCKING CLOSURE PROFILE CONFIGURATION

[75] Inventors: Michael G. Borchardt, Woodridge; Robert T. Dorsey, Chicago; Kevin H. Erwin, Naperville, Ewald A. Kamp, Chicago, all of Ill.

[73] Assignee: First Brands Corporation, Danbury, Conn.

[21] Appl. No.: 774,400

[22] Filed: Sep. 11, 1985

Related U.S. Application Data

[63] Continuation-in-part of Ser. No. 567,240, Dec. 30, 1983.

[51] Int. Cl.[5] ..... B65D 17/20

[52] U.S. Cl. ..... 24/576; 24/587

[58] Field of Search ..... 24/587, 576, 399, 400; 383/63, 64, 65

[56] References Cited

U.S. PATENT DOCUMENTS

| | | | |
|---|---|---|---|
| Re. 29,331 | 8/1977 | Naito | 24/587 |
| 2,558,367 | 6/1951 | Madsen | 24/576 |
| 2,869,207 | 1/1959 | Bernstein | 24/201 |
| 2,978,769 | 4/1961 | Harrah . | |
| 3,354,473 | 11/1967 | Schwarz et al. | 4/172 |
| 3,389,733 | 6/1968 | Siegel | 150/3 |
| 3,403,429 | 10/1968 | Smith | 24/204 |
| 3,416,585 | 12/1968 | Staller | 150/3 |
| 3,428,742 | 2/1969 | Smith | 174/136 |
| 3,535,746 | 10/1970 | Thomas | 24/30.5 |
| 3,633,642 | 1/1972 | Siegel | 150/3 |
| 3,846,575 | 11/1974 | Troy | 174/41 |
| 3,987,835 | 10/1976 | Bloomfield | 160/392 |
| 4,212,337 | 7/1980 | Kamp | 24/399 X |
| 4,285,105 | 8/1981 | Kirkpatrick | 24/587 |
| 4,561,108 | 12/1985 | Kamp | 24/399 X |

FOREIGN PATENT DOCUMENTS

| | | | |
|---|---|---|---|
| 475121 | 5/1947 | Canada | 24/587 |
| 1084488 | 1/1955 | France | 16/1 |
| 2037704 | 7/1980 | United Kingdom . | |

*Primary Examiner*—Peter A. Aschenbrenner
*Attorney, Agent, or Firm*—Gary L. Wamer

[57] ABSTRACT

An interlocking closure fastening device comprising an omega-shaped closure element and a co-acting clamping closure element. The co-acting clamping closure element may have a profile portion comprising two generally parallel arm portions wherein one of the arm portions terminates in an inwardly curved hook portion, and the other arm portion curves slightly inward prior to terminating in an outwardly extending clamp portion; or the profile portion may comprise two outwardly curved arm portions wherein one of the arm portions terminates in an inwardly curved hook portion, and the other arm portion curves inwardly prior to terminating in a slightly outwardly curved hook portion; or the profile portion may comprise one inwardly curved arm portion terminating in an inwardly curved hook portion, and one generally straight arm portion.

87 Claims, 6 Drawing Sheets

SINGLE HINGE INTERLOCKING CLOSURE PROFILE CONFIGURATION

This application is a continuation-in-part of prior U.S. application Ser. No. 567,240, filing date 12/30/83.

CROSS REFERENCE TO RELATED APPLICATION

This application is a continuation-in-part application of prior application Ser. No. 567,240 filed Dec. 30, 1983 for Single Hinge Interlocking Closure Profile Configuration, and is related to copending application Ser. No. 567,242 filed Dec. 30, 1983 for Interlocking Closure Bag for use in High Temperature Environment.

FIELD OF THE INVENTION

This invention relates to an interlocking closure fastening device, and more particularly, to an interlocking closure fastening device comprising an omega-shaped closure element and a co-acting clamping closure element.

BACKGROUND OF THE INVENTION

In general, closure fastening devices for use in connection with plastic bags and the like are known. Furthermore, manufacturing methods for closure fastening devices made of plastic material are generally well-known.

In operation, a closure fastening device for use in connection with a flexible container should be relatively easy to open from the outside, but relatively difficult to open from the inside. Generally, such a container can be used with its interior either under relatively high pressure or under relatively low pressure. The closure fastening device should provide a satisfactory seal for either condition.

Preferably, the closure fastening device should be suitable for economical manufacturing and should be relatively simple in design. In addition, the design should provide for variations in order to meet different needs. For example, it may be desirable to have a closure fastening device which is relatively difficult to open both from the inside and the outside. In general, the closure fastening device, however, should always be relatively easy to close.

In addition, when the closure fastening device is employed with a container, the container may be made from a thermoplastic material and the closure device and sidewalls of the container can be made integrally by extrusion as a unitary piece or can be made as separate components which are subsequently permanently connected together.

However, the thermoplastic resin materials heretofore found practical for the extrusion of interlocking closure devices, and their attachment to films, such as in making containers, have resulted in shrinkage and distortion problems during their use at elevated temperatures. Typical resin materials employed for interlocking closure devices and container films have included polyethylene, polyvinyl chloride copolymers, and synthetic rubbers. However, none of these construction materials have sufficient thermal tolerance for many commercial uses. Further, both occlusion and deocclusion of the interlocking closure device is generally difficult for the user when the device is made from resin materials having high temperature tolerances due to their associated high flexural moduli. Thus, in selecting a resin composition for the profile portions and the flange portions of a closure fastening device which is employed on a bag or container for use in a high temperature environment, such as in a microwave oven or boiling water, the resin composition must meet several criteria. These criteria include high heat resistance, relatively low flexural modulus at low temperatures, acceptable extrusion characteristics, and convertibility of the film into end products such as bags or containers. High heat resistance is necessary because when the bag or container is equipped with the interlocking closure fastening device and is used in a microwave oven where food temperatures can reach about 300° F., or in boiling water where the temperature of the cooking vessel can exceed 212° F., the closure fastening device must retain proper occlusion and deocclusion forces. The resin composition must also be flexible at low temperatures because such bags or containers are often used in a freezer for food storage, and when removed from the freezer, the closure fastening device must be sufficiently flexible so that the bags or containers can be easily opened when such is desired as to remove food therefrom. In addition, the resin composition for the interlocking closure fastening device must have acceptable extrusion characteristics so that it can be easily processed in production and make a reliable, reproducible product.

In the extrusion of such interlocking closure fastening devices, it is desirable to extrude closure elements having base and profile portions onto a common flange portion, separate the closure elements, and then attach the closure elements to the bags or containers. This operation presents a problem in the closure extrusion phase because some of the closure elements are near the outer edges of the flange portion which is an area conducive to "neck-in" of the resin material. "Neck-in" may be described as a decrease in an article's dimensions transverse to the take-off or elongation direction of the article. In such event, the edges of the flange portion exiting from the die will shrink toward the center of the flange portion in a curved path. When the edge of a flange portion "necks-in" toward the center of the flange portion, a closure element positioned near the flange edge will travel with the edge of the flange portion. The result is that the closure element is not extruded in a straight line as desired, but follows the curved path of the edge of the flange portion. This result causes distortion of the closure element due to the two dimensional path followed by the closure element. Therefore, in choosing a resin composition for the flange portion of a closure fastening device as described herein, it is highly desirable to employ a resin composition that suffers a minimum of "neck-in" so that the closure elements extruded near the outer edges of the flange portion travel in as close to a straight line as possible which minimizes closure distortion.

On the other hand, when choosing a resin composition for the closure elements, i.e., the base and profile portions, of the interlocking closure fastening device, the main concern is to employ a composition that will retain the intricate profile shapes of the closure elements during the extrusion process and during the cooling process. This concern is more important than limiting "neck-in" tendencies of the resin composition.

SUMMARY OF THE INVENTION

The foregoing criteria for a closure fastening device are met by this invention wherein the closure fastening device comprises a first closure element and a second closure element which are adapted to interlock by pressing the first closure element into the second closure element, and wherein the closure fastening device is made from a thermoplastic material comprising a polypropylene polymer. In one suitable fastening device includes a first closure element having a general omega shape comprising an apex portion, and a profile portion extending from the apex portion, said apex portion being generally flat or slightly arcuate, and said profile portion comprising two inwardly curved arm portions terminating in two outwardly facing, curvilinear hook portions. The closure device includes a second closure element having a generally flat or slightly arcuate apex portion, and a profile portion extending from the apex portion. The profile portion of the second closure element comprises first and second generally parallel arm portions wherein one of the arm portions terminates in an inwardly curved hook portion, and the other arm portion curves slightly inward prior to terminating in an outwardly extending clamp portion. The first closure element and the second closure element are adapted to disengage and engage each other by means of rotation of one closure element with respect to the other closure element, such as by a hinging action so as to form a straddling type of occlusion. A straddling type of occlusion occurs when one arm portion of the second closure element is lodged between the two arm portions of the first closure element, while the other arm portion of the second closure element is outside one of the arm portions of the first closure element when the closure device is occluded.

In another embodiment of this invention, the fastening device includes a first closure element having a general omega shape comprising an apex portion, and a profile portion extending from the apex portion, said apex portion being generally flat or slightly arcuate, and said profile portion comprising two inwardly curved arm portions terminating in two outwardly curving hook portions. The closure device includes a second closure element having a generally flat or slightly arcuate apex portion, and a profile portion extending from the apex portion. The profile portion of the second closure element comprises two outwardly curved arm portions wherein one of the arm portions terminates in an inwardly curved hook portion, and the other arm portion curves inwardly prior to terminating in a slightly outwardly curved hook portion. The first closure element and the second closure element are adapted to disengage and engage each other by means of rotation of one closure element with respect to the other closure element, such as by a hinging action so as to form an overlapping type of occlusion. An overlapping type of occlusion occurs when both arm portions of the first closure element are within, or inside of, both arm portions of the second closure element when the closure device is occluded.

In a further modification of the preceding embodiment, the profile portion of the second closure element comprises two outwardly curved arm portions wherein one of the arm portions terminates in an inwardly curved hook portion, and the other arm portion curves progressively inwardly as to make contact with one of the arm portions of the first closure element when the fastening device is occluded, prior to terminating in a slightly outwardly curved hook portion.

In a further embodiment of this invention, the fastening device includes a first closure element having a general omega shape comprising an apex portion, and a profile portion extending from the apex portion, said apex portion being generally flat or slightly arcuate, and said profile portion comprising two inwardly curved arm portions, an outwardly extending arm portion from each of said inwardly curved arm portions, each of said outwardly extending arm portion terminating in an outwardly curved hook portion. The closure device includes a second closure element having a generally flat or slightly arcuate apex portion, and a profile portion extending from the apex portion. The profile portion of the second closure element comprises one inwardly curved arm portion terminating in an inwardly curved hook portion, and one generally straight arm portion extending from said apex portion in a generally perpendicular direction therefrom. The first closure element and the second flexible closure element are adapted to disengage and engage each other by means of rotation of one closure element with respect to the other closure element, such as by a hinging action so as to form a straddling type of occlusion as earlier described. During deocclusion of the aforedescribed closure fastening devices, one closure element must be rotated between about 30 degrees to about 50 degrees with respect to the other closure element to disengage the arm portions thereof located closer to the exterior portion of a container, and further rotated between about 70 degrees to about 120 degrees with respect to the other closure element to disengage the arm portions thereof located closer to the interior portion of the container.

BRIEF DESCRIPTION OF THE DRAWINGS

FIG. 3-A is a cross-sectional view of a closure fastening device shown in FIG. 3 to illustrate typical physical dimensions;

DETAILED DESCRIPTION OF THE PREFERRED EMBODIMENTS

Figure 1:
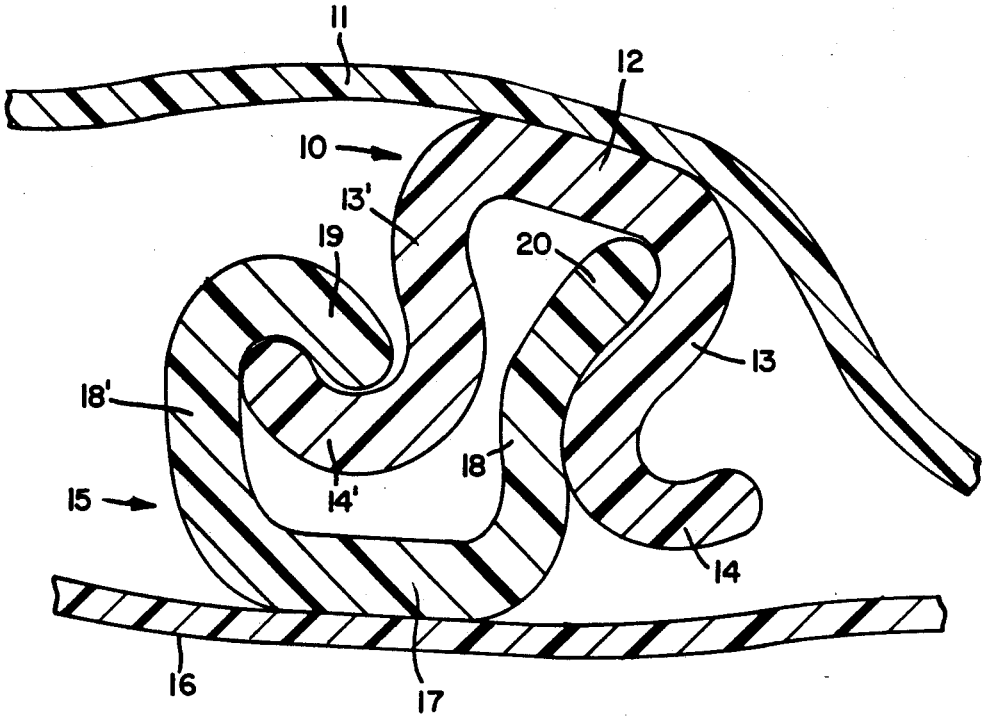
FIG. 1 is a cross-sectional view of one embodiment of the closure fastening device in accordance with this invention in an occluded position.

The closure fastening device of the instant invention may be made from a thermoplastic material selected from the group consisting of polyolefins such as polyethylene, polypropylene, and polybutylene; polyamides such as nylon; or other thermoplastic materials, including combinations thereof. The closure fastening device is preferably made from a thermoplastic resin composition comprising polypropylene, or a mixture of polypropylene resin and ethylene-propylene-diene monomer elastomer, or a mixture of polypropylene resin and ethylene-propylene copolymer elastomer. In the preferred mode, the closure fastening device of this invention is made from a polypropylene copolymer, or a blend selected from (a) a polypropylene copolymer and a polypropylene homopolymer, (b) a polypropylene copolymer and a polybutene copolymer, (c) a polypropylene copolymer and an elastomer, and (d) mixtures of (a), (b), and (c). More specifically, it is preferred that the closure elements comprise a poly(propylene-ethylene) copolymer having an ethylene content of less than about 5 percent by weight of the copolymer because too much ethylene will lower the melting point of the copolymer and cause distortion of the closure profile during extrusion, and between about 100 ppm and about 2000 ppm of a slip agent based on the weight of the polypropylene copolymer. The slip agent is preferably selected from fatty acid amides such as erucamide. Suitable alternative compositions for the closure elements comprise a blend of (a) from about 85 to about 95 percent by weight of polypropylene homopolymer and from about 5 to about 15 percent by weight, preferably about 10 percent by weight, of a poly-1-butene copolymer containing up to about 5 percent by weight of ethylene; (b) from about 85 to about 95 percent by weight of polypropylene homopolymer and from about 5 to about 15 percent by weight, preferably about 10 percent by weight, of ethylene-propylene-diene monomer elastomer; (c) from about 85 to about 95 percent by weight of polypropylene homopolymer and from about 5 to about 15 percent by weight, preferably about 10 percent by weight, of ethylene-methyl acrylate copolymer; (d) from about 10 to about 50 percent by weight of polypropylene homopolymer and from about 50 to about 90 percent by weight, preferably about 70 percent by weight, of a poly(propylene-ethylene) copolymer selected from the group of poly(propylene-ethylene) copolymers having a melt flow rate of between about 1.5 and about 8, and preferably, about 7 grams/10 minutes as determined by ASTM test method D-1238, Condition "L", and a flexural modulus of between about 100,000 and about 132,000 psi or an MPa value of between about 690 and about 924 as determined by ASTM test method D-790; and (e) from about 85 to about 95 percent by weight of poly(propylene-ethylene) copolymer and from about 5 to about 15 percent by weight, preferably about 10 percent by weight, of a copolymer selected from the group consisting of (1) a poly-1-butene copolymer containing up to about 5 percent by weight of ethylene; (2) an ethylene-propylene-diene monomer elastomer; and (3) an ethylene-methyl acrylate copolymer. As in the best mode compositions employed to make the closure fastening devices herein, all of the alternative compositions preferably contain between about 100 ppm and about 2000 ppm of a slip agent selected from fatty acid amides based on the weight of the blends.

The foregoing resin materials are all commercially available. For example, the poly(propylene-ethylene) copolymer material may be obtained from Himont Inc., Wilmington, Del. under the tradename Pro-Fax® SA-861; the polypropylene homopolymer may be obtained from Shell Chemical Company under the tradename Shell Polypropylene 5225; the poly-1-butene copolymer containing up to about 5 percent by weight of ethylene may be obtained from Shell Chemical Company under the tradename Shell Polybutylene 8640; the ethylene-propylene-diene monomer elastomer may be obtained from Uniroyal Chemical, Naugatuck, Conn. under the tradename Royalene IM 7565 as a 65/35 weight blend of the elastomer (high density polyethylene; the ethylene-methyl acrylate copolymer is available from Gulf Oil Chemicals Company under the tradename PE 2205; the poly(propylene-ethylene) copolymer may also be obtained from Cosden Oil Company under the tradenames Dypro W-431 and Dypro K-122, and from Himont Inc., Wilmington, Del. under the tradename Pro-Fax® SA-752.

It has been found that when interlocking closure elements are made from the foregoing resin compositions, the profile portions of the closure elements retain their shapes and have a low flexural modulus under the extreme temperature conditions thereby meeting the aforementioned criteria for an interlocking closure fastening device. The poly(propylene-ethylene) copolymer enhances the extrudability of the closure elements because they retain their shapes better during manufacture than when made from other materials. The dimensions of the closure fastening device may vary in accordance with intended use, and depending upon the materials used in their manufacture because of the variations in physical properties, such as flexural moduli.

The closure fastening device of this invention can be manufactured by known methods such as by extrusion, by the use of molds or other known methods of producing such devices. The closure fastening device can be manufactured as a strip for later attachment to a film or it can be manufactured integral with the film. In addition, the closure device can be manufactured with or without flanges on one or both of the closure elements, depending upon intended use or expected additional manufacturing operations.

Thus, when the closure device is connected to a container, it is preferred that the closure device be manufactured with flanges on each of the closure elements so that the flanges can be used to connect the closure elements to the container or to a film to be formed into a container. The flanges of the closure device may be made from a thermoplastic material selected from the group consisting of a polypropylene homopolymer, a poly-1-butene copolymer, an ethylene-propylene-diene monomer elastomer, and an ethylene-methyl acrylate copolymer. However, in the best mode of this invention, the flanges of the closure device are made from a blend of a polypropylene homopolymer and a poly-1-butene copolymer. More specifically, it is preferred that the flanges comprise from about 85 to about 95 percent by weight of polypropylene homopolymer and from about 5 to about 15 percent by weight of poly-1-butene copolymer containing up to about 5 percent by weight of ethylene. More preferably, the flanges comprise about 90 percent by weight of polypropylene homopolymer and about 10 percent by weight of poly-1-butene copolymer containing up to about 5 percent by weight of ethylene. Less preferred, but suitable, alternative material compositions for the flanges comprise (a) from about 85 to about 95 percent by weight of polypropylene homopolymer and from about 5 to about 15 percent by weight of ethylene-propylene-diene monomer elastomer; or (b) from about 85 to about 95 percent by weight of polypropylene homopolymer and from about 5 to about 15 percent by weight of ethylene-methyl acrylate copolymer, or (c) mixtures of (a) and (b).

The foregoing resin materials are commercially available. For example, the polypropylene homopolymer material may be obtained from Shell Chemical Company under the tradename Shell Polypropylene 5225; the poly-1-butene copolymer containing up to about 5 percent by weight of ethylene may be obtained from Shell Chemical Company under the tradename Shell Polybutylene 8640; the ethylene-propylene-diene monomer elastomer may be obtained from Uniroyal Chemical, Naugatuck, Conn., under the tradename Royalene IM 7565 as a 65/35 weight blend of the elastomer/high density polyethylene; and the ethylene-methyl acrylate copolymer is available from Gulf Oil Chemicals Company under the tradename PE 2205.

It has been found that when the flange portions of the interlocking closure fastening device of this invention are made from the foregoing resin compositions, distortion of the closure elements is significantly reduced since the flange portions of the closure device experience minimal neck-in during extrusion. It has been found that the polypropylene homopolymer reduces neck-in of the flange portions during extrusion, and that the presence of poly-1-butene reduces the flexural modulus of the polypropylene homopolymer making the device suitable for use after storage in a freezer. In preferred practice, the flanges and the closure elements are coextruded, however, the flanges and the closure elements may be extruded separately and then attached to each other by conventional means.

The closure elements can be connected to a container or to a film to be formed into a container by the use of many known methods. For example, a thermoelectric device can be applied to a film opposite a closure element to cause a transfer of heat through the film to produce melting at the interface of the film and the closure element. After cooling, the interface region joins the film and the closure element.

The thermoelectric device can be heated by rotary discs, or resistance heated wires, or traveling heater bands, or the like.

The connection between the film and the closure element can also be established by the use of hot melt adhesives, or hot jets of air to the interface, or ultrasonic heating, or other known methods.

Generally, the present closure fastening device can be made from a heat sealable material and then attached to a heat sealable film so that a container can be formed economically by heat sealing surfaces to form the container.

The instant closure fastening device provides many advantages for consumers when used on containers. For instance, it is easy to open and close a container because the closure elements hinge or rotate with respect to each other from the deoccluded to the occluded position, and from the occluded position to the deoccluded position with little effort, even though the closure device is made from high flexural moduli resins having high temperature resistance. An important aspect of the closure fastening device of this invention is its ability to function properly when made with materials which are less flexible than those employed in the prior art. That is, prior art closures are generally made of polyethylene having a low flexural modulus, and engage and disengage by a flexing action, whereas the instant closures are different therefrom in that they function by a hinging action or operation since they are made from high temperature resistant resin materials having high flexural modulus properties, i.e., at least about 50,000 psi. The action contrasts with prior art structures such as arrow type of closures where, in the female elements, the hooked sides have to be bent or otherwise distorted for occlusion or deocclusion. In a prior art channel closure a base portion has to be bent to accomplish occlusion or deocclusion. And still another structure made very stiff, requires longitudinal displacement to a non-hooked end before the male and female elements can be pried apart by elastic bending of portions of each element.

For a fuller understanding of the nature of the invention, reference should be had to the following detailed description, taken in conjunction with the accompanying drawings.

FIG. 1 is a cross-sectional view of one embodiment of the closure fastening device in accordance with this invention, in an occluded position. As shown therein, a first closure element 10 having a general omega shape is connected to a flange portion 11 for use in connection to a thermoplastic film. Closure element 10 has an apex portion 12 which is typically flat or slightly arcuate, and extending from apex portion 12 is a profile portion which comprises two inwardly curved arm portions 13 and 13' which terminate in two outwardly curving hook portions 14 and 14', respectively. A second closure element 15 is shown connected to a flange portion 16, and it comprises an apex portion 17 which may have a flat or slightly arcuate configuration. Extending from apex portion 17 is a profile portion comprising two generally parallel arm portions 18 and 18'. Arm portion 18' terminates in an inwardly curved hook portion 19, whereas arm portion 18 curves slightly inwardly prior to terminating in an outwardly extending clamp portion 20. As shown in FIG. 1, when the closure fastening device is in an occluded position, hook portion 14' of closure element 10 and hook portion 19 of closure element 15 are interlocked, and arm portion 18 and clamp portion 20 of closure element 15 are in locked contact with arm portion 13 of closure element 10. It can also be seen from FIG. 1 that arm portion 18' terminating in inwardly curved hook portion 19 is adapted to engage in a hinging contact with arm portion 13' terminating in outwardly curving hook portion 14', and arm portion 18 terminating in outwardly extending portion 20 is adapted to engage in a clamping contact with arm portion 13 terminating in outwardly curving hook portion 14. As can be seen from FIG. 1, closure element 10 and closure element 15 form a straddling occlusion wherein arm portion 18 and clamp portion 20 of closure element 15 are positioned between arm portions 13 and 13' of closure element 10. When the closure fastening device is connected to a plastic container, arm portion 13 and hook portion 14 are positioned closest to the mouth or outside portion of the container, and arm portion 18' is positioned closest to the interior or inside portion of the container.

Figure 2:
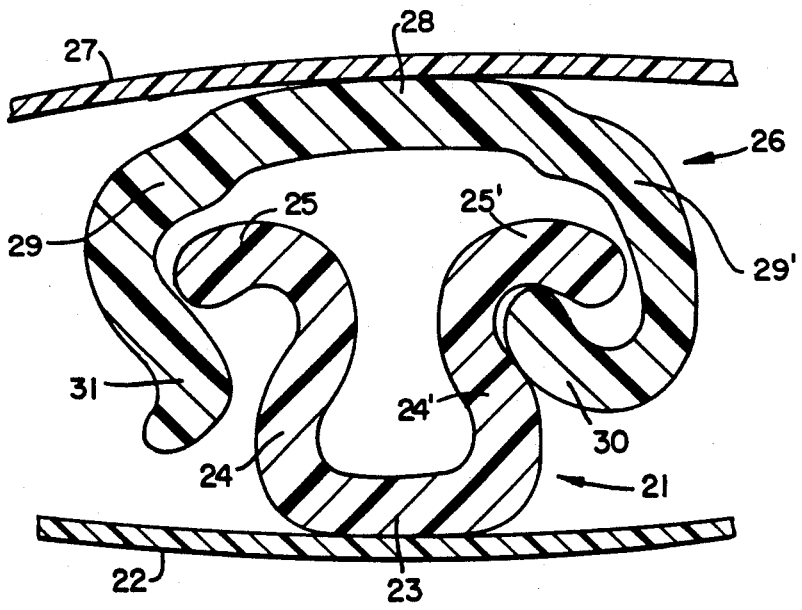
FIG. 2 is a cross-sectional view of another embodiment of the closure fastening device in accordance with this invention in an occluded position.

FIG. 2 is a cross-sectional view of another embodiment of the closure fastening device in accordance with this invention, in an occluded position. It may be seen therefrom that the first closure element 21 has a general omega shape, and that it may be connected to a flange portion 22 for connection to a thermoplastic film. Closure element 21 has an apex portion 23 which is slightly arcuate or generally flat, and extending from apex portion 23 is a profile portion which comprises two inwardly curved arm portions 24 and 24' which terminate in two outwardly curving hook portions 25 and 25', respectively. A second closure element 26 is shown connected to a flange portion 27, and it comprises an apex portion 28 which has a flat or slightly arcuate configuration. Extending from apex portion 28 is a profile portion comprising two outwardly curving arm portions 29 and 29'. Arm portion 28' terminates in an inwardly curved hook portion 30, and arm portion 29 curves inwardly prior to terminating in a slightly outwardly curved hook portion 31. From FIG. 2, it may be seen that when the closure fastening device is in an occluded position, hook portion 25' of closure element 21 and hook portion 30 of closure element 26 are interlocked, while arm portion 29 and hook portion 31 of closure element 26 are in contact with hook portion 25 of closure element 21. It can also be seen from FIG. 2 that arm portion 29' terminating in inwardly curved hook portion 30 is adapted to engage in a hinging contact with arm portion 24' terminating in outwardly curving hook portion 25', and arm portion 24 terminating in outwardly curving hook portion 25 is adapted to engage in a clamping contact with arm portion 29 terminating in outwardly curved hook portion 31. It can further be seen from FIG. 2 that closure element 21 and closure element 26 form an overlapping type of occlusion wherein hook portion 30 of closure element 26 overlaps hook portion 25' of closure element 21, and arm portion 29 and hook portion 31 of closure element 26 overlap hook portion 25 of closure element 21. When thus occluded, arm portion 29 and hook portion 31 of closure element 26, and hook portion 25 of closure element 21, together form an easily disengagable structure, while hook portion 30 of closure element 26 and hook portion 25' of closure element 21 form a hinge structure which is strongly resistant to deocclusion without considerable rotation.

Figure 3:
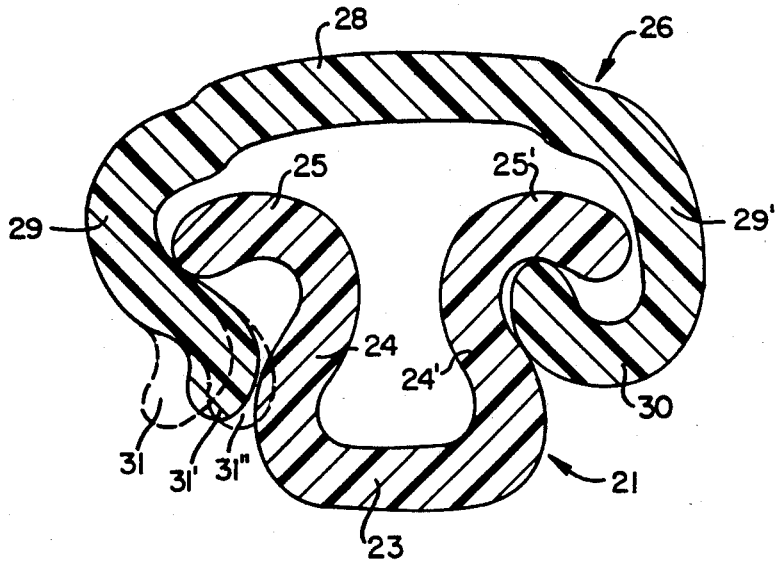
FIG. 3 is another cross-sectional view of the embodiment of the closure fastening device shown in FIG. 2.
Figure 3A:
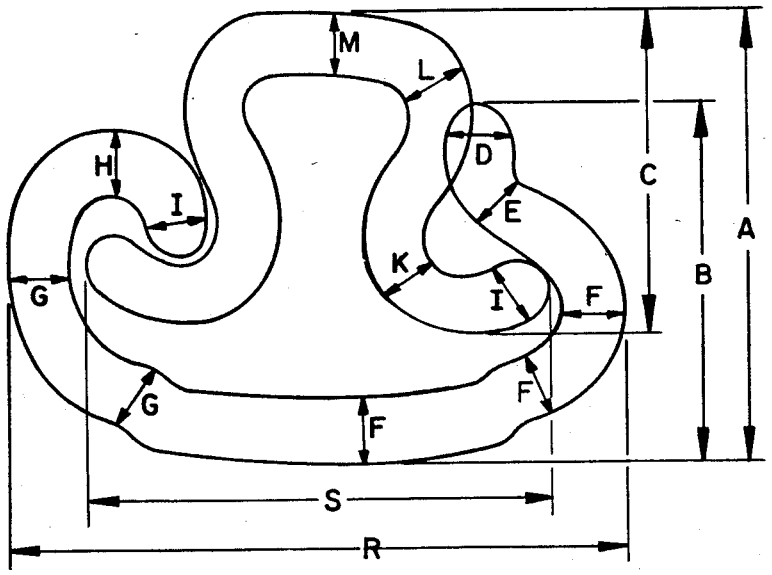
Figure 4:
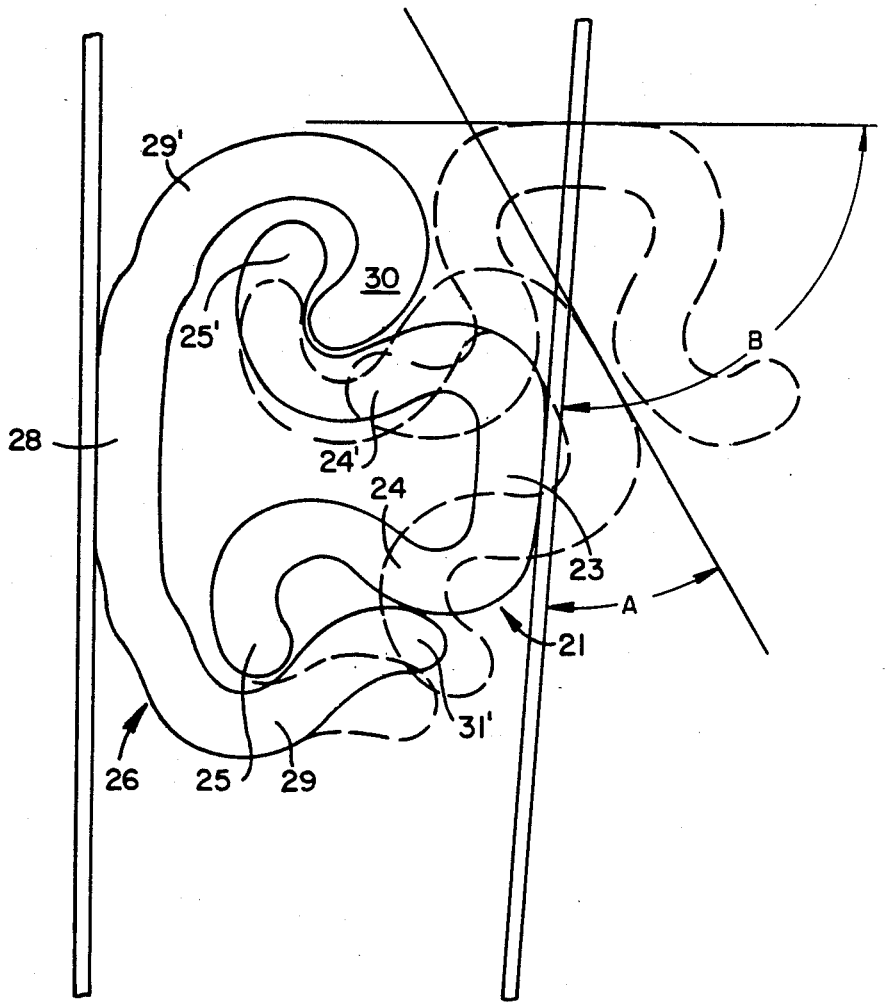
FIG. 4 is a cross-sectional view of the closure fastening device shown in FIG. 3 in an occluded position, in a partially deoccluded position, and in a deoccluded position.

FIG. 3 is a free body diagram showing a cross-sectional view of the closure fastening device shown in FIG. 2. The first closure element 21 shown therein is the same as that shown in FIG. 2. However, the second closure element 26 has been modified, whereby hook portion 31 may be positioned progressively laterally inward, as depicted by alternate hook portion 31' and alternate hook portion 31'' shown in free body, toward arm portion 24 of closure element 21 until hook portion 31 makes contact with said arm portion 24 or is even deflected outwardly by arm portion 24. When the closure fastening device is thus constructed, the successively inward curvature of arm portion 29 and hook portion 31 to the positions shown by hook portion 31' and hook portion 31'' results in gradually increasing the opening force required to separate and deocclude closure element 26 and closure element 21. It has been found that successively inwardly curving hook portion 31 to the position depicted by hook portion 31'' results in increasing the external opening force required in deoccluding closure element 26 and closure element 21 from a force of about 0.5 pound to a force of about 2.0 pounds. It was also found that hook portion 31' and hook portion 31'' result in increased interference between these hook portions and hook portion 25, thereby requiring bending of these parts during deocclusion of closure element 26 and closure element 21. In operation, hook portions 31, 31' and 31'' act as a clamp in maintaining occlusion of the closure device. By the same token, hook portion 25' and hook portion 30 provide a hinge action during deocclusion of closure element 26 and closure element 21 whereby hook portion 25' rotates with respect to hook portion 30 as shown in FIG. 4.

FIG. 3-A is a cross-sectional view of the closure fastening device shown in FIG. 3 wherein the second closure element is modified pursuant to alternate hook portion 31''. The typical physical dimensions of a closure fastening device in accordance with FIG. 3-A are as follows:

1. A may be from about 0.050 to about 0.140 inch, preferably about 0.120 inch;
2. B may be from about 0.040 to about 0.100 inch, preferably about 0.080 inch;
3. C may be from about 0.040 to about 0.100 inch, preferably about 0.080 inch;
4. D may be from about 0.007 to about 0.015 inch, preferably about 0.009 inch;
5. E may be from about 0.008 to about 0.015 inch, preferably about 0.011 inch;
6. F may be from about 0.008 to about 0.015 inch, preferably about 0.013 inch;
7. G may be from about 0.008 to about 0.015 inch, preferably about 0.012 inch;
8. H may be from about 0.008 to about 0.015 inch, preferably about 0.011 inch;
9. I may be from about 0.007 to about 0.012 inch, preferably about 0.008 inch;
10. K may be from about 0.008 to about 0.015 inch, preferably about 0.011 inch;
11. L may be from about 0.008 to about 0.015 inch, preferably about 0.012 inch;
12. M may be from about 0.009 to about 0.020 inch, preferably about 0.017 inch;
13. R may be from about 0.050 to about 0.130 inch, preferably about 0.140 inch; and
14. S may be from about 0.034 to about 0.224 inch, preferably about 0.116 inch.

As indicated in FIG. 3-A, A represents the height dimension of the closure fastening device in an occluded position as measured from the apex portion of the first closure element to the apex portion of the second closure element.

B represents the height dimension of the second closure element as measured from the apex portion of the second closure element to the tip of the second arm portion of the second closure element.

C represents the height dimension of the first closure element as measured from the apex portion of the first closure element to the highest part of the profile portion of the first closure element.

R represents the width dimension of the second closure element as measured from the widest part of the first arm portion of the second closure element to the widest part of the second arm portion of the second closure element.

S represents the width dimension of the first closure element as measured between the tips of the outwardly facing hook portions of the first closure element.

FIG. 4 is a cross-sectional view of the closure fastening device shown in FIG. 2 in an occluded position, in a partially deoccluded position, and in a deoccluded position. It has been found that during occlusion and deocclusion of the closure fastening device of this invention, one or both of the closure elements of the fastening device experience a gradual rotating or hinging operation spread over a significant length of the closure on either side of the point of initial force application. The spreading action of this hinging operation reduces stress levels, thereby reducing force. During deocclusion of the fastening device, this rotating or hinging operation continues until the hook portions of the closure elements have disengaged from each other.

FIG. 4 shows in detail some of the operational steps during deocclusion of a closure fastening device as described with respect to FIG. 3 wherein the second closure element is modified pursuant to alternate hook portion 31'. More specifically, when said closure fastening device is in the occluded position, hook portion 31' of closure element 26 is in contact with arm portion 24 of closure element 21, or hook portion 25 of closure element 21 is in contact with arm portion 29 of closure element 26. Typically, for deocclusion of the closure fastening device, an external release force is exerted on hook portion 31' and arm portion 29 of closure element 26, and on hook portion 25 and arm portion 24 of closure element 21, to cause release of hook portion 31' and arm portion 29 of closure element 26, from hook portion 25 and arm portion 24 of closure element 21. The aforementioned parts of the fastening device are rotated over an arc of about 35° C. to a position generally designated as A, as shown by the arrows in FIG. 4. In order to obtain full release of the closure elements and deocclusion of the fastening device, rotation of the closure elements is continued over an arc of between about 100° C. and 120° C. to a position generally designated as B, as shown by the arrows in FIG. 4. During the continued rotation, arm portion 24' and hook portion 25' of closure element 21, disengage from hook portion 30 of closure element 26, while rotating around hook portion 30 of closure element 26 until the parts are separated from each other.

Figure 5:
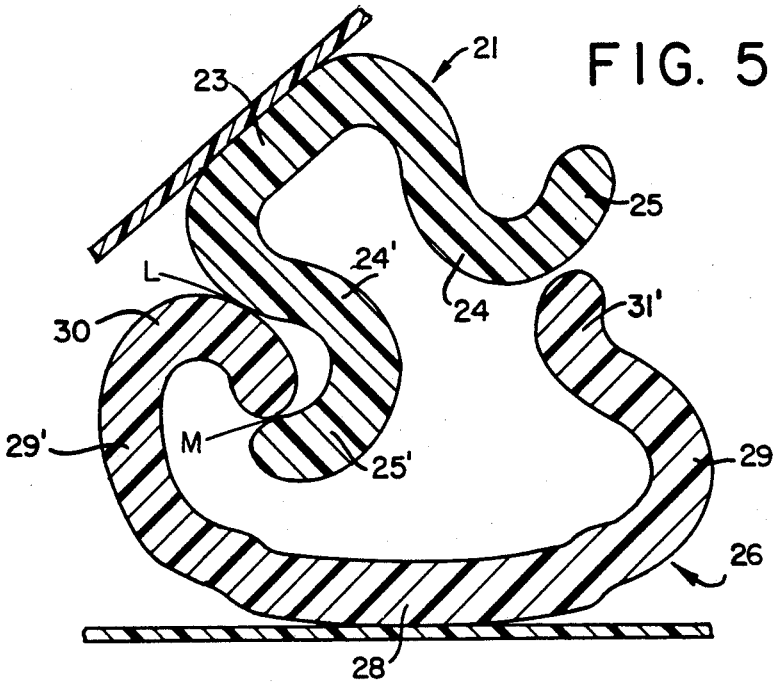
FIG. 5 is a cross-sectional view of a preferred embodiment of the closure fastening device in accordance with this invention in a partially deoccluded position.

If a closure fastening device is preferred requiring a smaller arc of rotation resulting in earlier deocclusion of the closure elements, then closure element 21 and closure element 26 may be modified as described with respect to FIG. 5. In FIG. 5 is shown the closure elements described with respect to FIG. 4 with the following modifications having been made thereto. More particularly, the inside radius of curvature of hook portion 30 is decreased. During deocclusion of the closure fastening device, after hook portion 31' and arm portion 29 of closure element 26 are released from hook portion 25 and arm portion 24 of closure element 21, continued rotation of the closure elements results in hook portion 30 of closure element 26 having a camming or leverage effect upon arm portion 24' and hook portion 25' of closure element 21 to provide release of these parts at an arc of about 75° . The contact point between hook portion 30 of closure element 26 and arm portion 24' of closure element 21 is generally designated in FIG. 5 as point L, and the contact point between hook portion 30 of closure element 26 and hook portion 25' of closure element 21 is generally shown therein as point M. It has been found that the aforedescribed closure elements provide deocclusion of the occluded fastening device more quickly by requiring a lesser amount of rotation of the closure elements without affecting good occlusion.

It should be noted at this point that the actions discussed and illustrated for deocclusion apply in the reverse order to occlusion, which re-engages the hook elements forming the hinge structure, releases torsionally rotated elements and, by further movement, re-establishes the clamping action. This is predicated upon portions of the closure being maintained in an occluded position at the terminal ends of the closure device. Such a condition exists when a length of such a closure device is incorporated in a plastic bag having sealed side edges.

Figure 6:
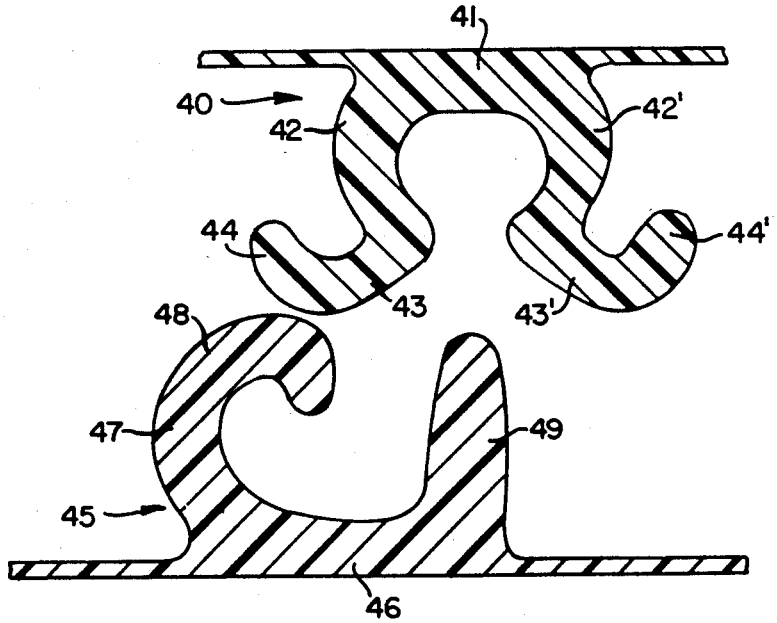
FIG. 6 is a cross-sectional view of another embodiment of the closure fastening device in accordance with this invention in a deoccluded position.

FIG. 6 is a cross-sectional view of another embodiment of the closure fastening device in accordance with this invention in a deoccluded position. As shown therein, the closure fastening device includes a first closure element 40 having a general omega shape, and comprises a generally flat or slightly arcuate apex portion 41 and a profile portion extending from the apex portion. The profile portion comprises two inwardly curved arm portions 42 and 42', respectively, with arm portions 43 and 43' outwardly extending from said inwardly curved arm portions, respectively, and with said outwardly extending arm portions terminating in outwardly curving hook portions 44 and 44', respectively. The closure fastening device includes a second closure element 45 having a generally flat or slightly arcuate apex portion 46 and a profile portion extending from said apex portion. The profile portion of said second closure element comprises one inwardly curved arm portion 47 terminating in an inwardly curved hook portion 48, and one generally straight arm portion 49 extending in a generally perpendicular direction from said apex portion.

Figure 7:
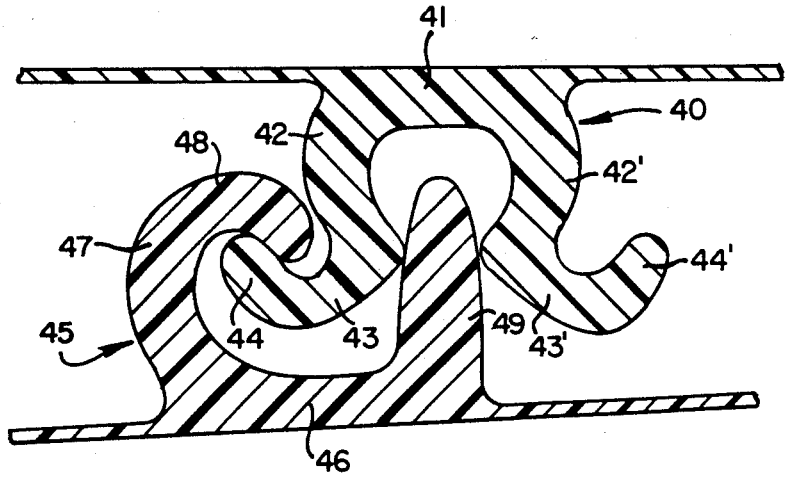
FIG. 7 is a cross-sectional view of the closure fastening device shown in FIG. 6 in an occluded position.

FIG. 7 is a cross-sectional view of the closure fastening device described with respect to FIG. 6, but shown herein in an occluded position. It can be seen from FIG. 7 that when the instant closure fastening device is in an occluded position, arm portion 49 of closure element 45 is located between and in contact with outwardly extending arm portions 43 and 43' of closure element 40, and hook portion 44 of closure element 40 is interlocked with hook portion 48 of closure element 45. It can also be seen from FIG. 7 that arm portion 43 terminating in outwardly curving hook portion 44 is adapted to engage in a hinging contact with arm portion 47 terminating in inwardly curved hook portion 48, and arm portion 49 is adapted to engage in a clamping contact with either arm portion 43 or arm portion 43', or both arm portion 43 and arm portion 43', but in any event, with at least one of said arm portions. When this closure fastening device is employed with a container, hook portion 44' and arm portion 49 are preferably located toward the outside portion of the container, and hook portion 44 and hook portion 48 are located toward the inside portion of the container. When thus located on a container, the closure fastening device of this invention provides a fastening device which is relatively easy to deocclude or open from the outside of the container even though the closure device is made from high flexural modulus materials and the device is used in a low temperature environment such as a freezer, but which is relatively difficult to deocclude or open from the inside of the container. Accordingly, when thus employed on a container, the closure fastening device provides easy access to the contents of the container, and also provides improved security to contents stored in said container.

Figure 8:
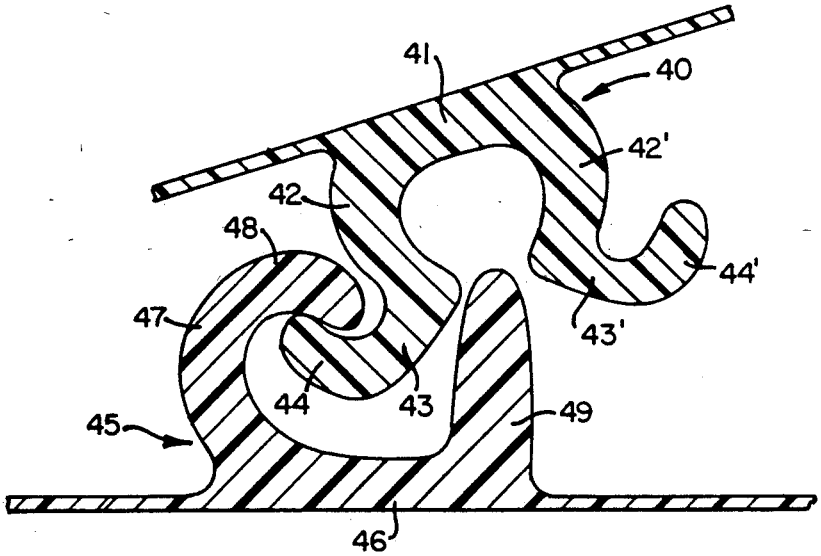
FIG. 8 is a cross-sectional view of the closure fastening device shown in FIG. 7 in a partially deoccluded position during deocclusion.

FIG. 8 is a cross-sectional view of the closure fastening device shown in FIG. 7 in a partially deoccluded position such as during deocclusion of the fastening device. It may be seen from FIG. 8 that during deocclusion of closure element 45 and closure element 40, arm portions 43 and 43' of closure element 40 first separate from arm portion 49 of closure element 45. As closure element 40 and closure element 45 are further rotated with respect to each other for separation, hook portion 44 of closure element 40 will rotate around and then slip away from hook portion 48 of closure element 45, thereby resulting in their separation and in the complete deocclusion of the closure fastening device.

Some of the preferred closure fastening devices of this invention were evaluated for opening loads for comparison with several commercial plastic container products having a closure fastening device. In all the evaluations, each occluded closure fastening device was cut into a six inch long sample. The closure fastening device samples were tested by attaching a piece of one inch wide scotch tape doubled over to grip the inside and/or outside flange portions of the fastening device. Each sample was tested independently as described herein. The male portion of the closure fastening device was mounted in the upper jaw, and the female portion of the closure fastening device was mounted in the lower jaw, of an Instron® tensile tester. The force required to deocclude the closure fastening device was recorded on a strip chart recorder as the maximum force registered. The average value was listed as the average of five test specimens and it was recorded as release force. The jaw separation (deocclusion ) rate was 20 inches per minute and the full scale load was 20 pounds. Each of 5 identical samples was reoccluded and retested for a total of 5 tests.. The value reported was thus the average of 25 tests for each sample.

The Instron instrument was a tensile tester Model No. 1130, using a "B" load cell with a zero to 20 pound range. The Instron tester is initially calibrated in the following manner. The pen and chart recorder are turned on. The zero button is pressed and held, and the zero adjust knob is positioned for a 0.00 reading on the recorder. The zero button is then released. The range switch is then turned to the setting of 1 on its 1, 2, 5, 10, 20 scale. The coarse balance control is turned so that if the pen is all the way over to the left, it starts coming towards zero on the right. The coarse balance control is left at this position. Then the fine balance control is turned so that the pen is at a setting of 0.00. A 20 pound weight is placed in the upper jaw of the Instron instrument and the calibration control is adjusted for a full-scale recorder reading. After removing the weight, the recorder should again read 0.00. The zero button is pressed and held, and the recorder should again read 0.00.

Sample 1 represents a closure fastening device employed with a container available from Dow Chemical Company, Midland, Mich. under the Tradename ZIPLOC®. The closure fastening device is believed to have been made with low density polyethylene having a density of about 0.921 grams per cubic centimeter.

Sample 2 represents a closure fastening device employed with a container available from Dow Chemical Company, Midland, Mich. under the tradename ZIPLOC® Microfreez.

Sample 3 represents a closure fastening device produced by Union Carbide Corporation and commercially available with a container identified as SNAP LOCK®. The closure fastening device was made with low density polyethylene, that is, having a density of about 0.923 grams per cubic centimeter.

Sample 4 represents a closure fastening device prepared in accordance with this invention and as described herein with respect to FIG. 3, wherein the second closure element was modified pursuant to alternate hook portion 31'.

Sample 5 represents a closure fastening device prepared in accordance with this invention and as described herein with respect to FIG. 3, wherein the second closure element was modified pursuant to alternate hook portion 31''.

The closure fastening devices of sample 4 and sample 5 were made with a thermoplastic resin composition comprising about 84 percent by weight of polypropylene homopolymer, about 15 percent by weight of an ethylene-propylene-diene monomer elastomer, and about 1 percent by weight of a slip agent, all weight percentages being based on the weight of the fastening device.

Both external release forces and internal release forces were recorded. By external release forces is meant the forces required to deocclude the closure fastening device from the outside portion of a container. By internal release forces is meant the forces required to deocclude the closure fastening device from the inside portion of a container.

The test results are given below in Table 1.

TABLE 1

| | Release Force (lbs) | | Force Ratio |
|---|---|---|---|
| Sample | Internal | External | (Internal:External) |
| 1 | 3.8 | 1.5 | 2.5:1.0 |
| 2 | 3.3 | 1.6 | 2.1:1.0 |
| 3 | 4.5 | 2.5 | 1.8:1.0 |
| 4 | 10.0 | 0.5 | 20.0:1.0 |
| 5 | 12.0 | 2.0 | 6.0:1.0 |

From the above results in Table 1, it can be seen that the closure fastening devices of this invention, i.e., samples 4 and 5, provide internal release resistance forces which are between two and three times as high as those of some commercial closure fastening devices, while manipulative external deocclusion forces may be held to a minimum, thereby providing easy and gentle deocclusion of the closure fastening devices of this invention. Further, the external deocclusion forces of the closure devices of samples 4 and 5 were low despite the fact that they were made from a high flexural modulus material, i.e., polypropylene homopolymer, while the closure devices of samples 1, 2, and 3 were made from a relatively low flexural modulus material, i.e., polyethylene Nine resin materials were evaluated for use in the closure fastening devices of this invention. These materials were evaluated to compare polypropylene materials having a high melting point and a high flexural modulus to measure closure deocclusion forces required and their thermal stability. Resin material no. 1 (Shell 5225) was a polypropylene homopolymer having a flexural modulus of about 190,000 psi, a flow index of about 0.6 gram/10 minutes, and a melting point of about 325° F. Resin material no. 2 (Shell DX 6020) was a poly(propylene-ethylene) random copolymer having a flexural modulus of about 110,000, a flow index of about 2.0 grams/10 minutes, and a melting point of at least 270° F. Resin material no. 3 (Cosden Dypro K-122) was a poly(-propylene-ethylene) random copolymer having a flexural modulus of about 120,000, a melt index of about 1.5 grams/10 minutes, and a melting point of about 297° F. Resin material no. 4 (Cosden Dypro W-431) was a poly(propylene-ethylene) random copolymer having a flow index of about 3.0 grams/10 minutes, and a melting point of about 275° F. Resin material no. 5 (Norchem 7300 GF) was a poly(propylene-ethylene) random copolymer having a flexural modulus of about 120,000 and a flow index of about 2.0 grams/10 minutes. Resin material no. 6 (Norchem 1510 LC) was a poly(propylene-ethylene) random copolymer having a flexural modulus of about 120,000, a flow index of about 1.0 gram/10 minutes, and a melting point of about 330° F. Resin material no. 7 (Cosden Dypro X-7350) was a poly(propylene-ethylene) random copolymer having a flexural modulus of about 75,000, a flow index of about 1.5 grams/10 minutes, and a melting point of about 264° F. Resin material no. 8 (Himont SA-752) was a poly(propylene-ethylene) random copolymer having a flexural modulus of about 132,000, a flow index of about 3.0 grams/10 minutes, and a melting point of about 275° F. Resin material no. 9 (Himont SA-861) was a polypropylene block copolymer having a flexural modulus of about 120,000 psi, a flow index of about 7.0 grams/10 minutes, and a melting point of about 315° F.

After extrusion into closure fastening devices having the structural configuration of FIG. 2, the resin materials were evaluated for opening forces required from the outside and from the inside of a container, and also for peel force. Peel force is a measure of the force required to pull the two closure elements apart after they have been partially deoccluded to form an initial opening in the closure device. A high peel force is desirable to enable opening a container only to a small extent. Such a small opening can act as a vent to either squeeze the air out of the container before freezing, or let steam escape from the container during cooking. The peel force is measured by placing a partially opened closure device in the jaws of a tensile tester available from Instron Corp., Canton, Mass., with the first closure element in one jaw and the second closure element in the other jaw. The tensile tester pulls the two closure elements apart at a speed of about 20 inches per minute, and the peel force of the closure device is measured. These results are tabulated in Table 2 which follows. In addition, the resin materials were evaluated for heat resistance in a boiling water test, as well as for shrinkage and general appearance. In this test, six-inch long samples are placed in boiling water for about 30 minutes. These results are tabulated in Table 3 which follows. The resin materials were further evaluated for heat resistance in a hot oil bath test at 250° F. and 300° F. and shrinkage measurements were taken. In this test, seven-inch long samples are placed in the hot oil batch for about three minutes. The results of this test are shown in Table 4 which follows.

TABLE 2

| Resin Material | Opening Forces, Pounds, Mean | | Peel Force, Grams, Mean |
|---|---|---|---|
| | Outside | Inside | |
| 1 | 2.0 | 12.0 | 70 |
| 2 | 4.2 | 4.6 | 52 |
| 3 | 7.9 | 3.0 | 73 |
| 4 | 2.1 | 11.3 | 32 |
| 5 | 0.9 | 3.5 | 14 |
| 6 | 1.7 | 5.8 | 27 |
| 7 | 3.6 | 9.1 | 67 |
| 8 | 1.2 | 12.3 | 14 |
| 9 | 1.3 | 9.5 | 19 |

TABLE 3

| Resin Material | Water Boil Test | |
|---|---|---|
| | Shrinkage* | Appearance |
| 1 | 0 by 0 | Good |
| 2 | 0 by 0 | Good |
| 3 | 0 by 1 | Good |
| 4 | 8 by 4 | Good |
| 5 | Not tested | Not tested |

TABLE 3-continued

| Resin Material | Water Boil Test | |
|---|---|---|
| | Shrinkage* | Appearance |
| 6 | 5 by 1 | Good |
| 7 | 0 by 1 | Poor |
| 8 | Not tested | Not tested |
| 9 | 0 by 0 | Small waves in flange portion |

*Shrinkage values are dimensions in length by width measured in 64ths of one inch

TABLE 4

| Resin Material | Hot Oil Bath Test Shrinkage* | |
|---|---|---|
| | 250° F. | 300° F |
| 1 | 4.0 | 8.7 |
| 2 | 0.0 | 31.0 |
| 3 | 2.7 | 24.0 |
| 4 | 4.7 | destroyed |
| 5 | not tested | not tested |
| 6 | 4.0 | 8.5 |
| 7 | 19.5 | destroyed |
| 8 | 2.7 | 10.0 |
| 9 | 0.0 | 15.2 |
| Ziploc Microfreeze | 4.0(1) | 12.3(2) |

*Shrinkage values are length dimensions only measured in 64ths of one inch.
(1)The closure profiles sealed together.
(2)The closure profiles and flange Portions sealed together.

From the preceding test results, it was determined that resin materials 1, 6, and 9 unexpectedly possessed preferred properties in terms of closure opening forces and thermal stability required for the closure fastening devices of this invention. In addition, it was found that these resin materials had excellent extrudability, and also laminated well to the film material employed to make the food containers.

It has further been found that the closure fastening devices of this invention are particularly suitable for use with a container for food, wherein the container is employed to store food in a freezer, and subsequently placed in a cooking vessel, such as a pot containing boiling water, or placed in a microwave oven for cooking the food. Significantly, the closure fastening devices of this invention have high resistance to heat, while possessing satisfactory low temperature flexing properties.

Further, some of the preferred closure fastening devices of this invention were evaluated for end-use application along with a commercial container available from Dow Chemical Company, Midland, Mich., under the tradename Ziploc® Microfreez bags. The closure fastening devices of this invention were laminated to a multilayer film to provide a series of containers. The containers were evaluated in a microwave oven by placing food in the containers and cooking the food for a time sufficient to raise the temperature of the food to about 300° F. Generally, speaking, it was found that the closure fastening devices of this invention were still intact when the containers were removed from the microwave oven and had only minimal distortion. However, the closure fastening device of the Ziploc® Mocrofreez bag, believed to be made from low density polyethylene having a melting point of about 220° F., melted during this cooking test even though food did not contact the closure fastening device. The Ziploc closure device was not functional after the cooking test.

In addition, the following closure fastening device compositions were evaluated. Test composition No. 1 consisted of a blend of about 90 parts by weight of a polypropylene homopolymer (Shell 5225) having a flexural modulus of about 190,000 psi, a melt index of about 0.6 gram/10 minutes, and a melting point of about 325° F., and about 10 parts by weight of a polybutylene copolymer containing up to about 5 percent by weight of ethylene (Shell 8640) wherein the blend was employed for the flange portion of the closure device. The profile portion of the closure device was made with a poly(propylene-ethylene) copolymer (Himont SA-861) having a melt flow rate of about 7 decigrams/minute, and a tensile modulus of between 90,000 and 95,000 psi. In addition, the poly(propylene-ethylene) copolymer employed to make the profile portion contained about 800 ppm of erucamide as a slip agent. This combination of resin materials was found to have good temperature tolerance at both hot and cold temperatures, as well as providing satisfactory opening and peel forces to the instant closure fastening devices.

In addition to its use with a container, the closure fastening device can be used to electrically insulate wire leads or bind together a group of wires. The closure device can also be used as a flexible straw because a good seal at the engaged surface is possible and the compartment defined by the elements provides a passageway which does not collapse when the closure fastening device is bent.

Generally, the closure device of the invention can be manufactured in a variety of forms to suit the intended use. In addition to the embodiments shown herein the elements can be positioned on opposite sides of a film. Such an embodiment would be suited for enwrapping an object or a collection of objects such as wires. Generally, the elements on a film should be parallel to each other but this would depend on the intended use.

Although the present invention has been described and set forth in some detail, it should be further understood that the same is susceptible to changes, modifications and variations without departing from the scope and spirit of the invention as set forth in the appended claims. That is, although emphasis has been given herein to describing specific structures of a closure fastening device, it should be understood that the resin materials of this invention may be employed to make other closure fastening devices having any suitable configuration or structure. Such changes, modifications and variations are within the scope of this invention.

I claim:

1. A closure fastening device comprising a first closure element and a second closure element; said first closure element having a general omega shape, comprising an apex portion and a profile portion extending from said apex portion, said profile portion comprising two inwardly curved arm portions terminating in two outwardly facing hook portions; said second closure element comprising an apex portion and a profile portion extending from said apex portion, said profile portion comprising first and second arm portions, said first arm portion terminating in an inwardly curved hook portion said first and second arm portions of said second closure element being adapted to receive therebetween one arm portion of said first closure element the hook portion of the latter arm being received in hinging engagement under the inwardly curved hook portion of the first arm of said second closure element, the other arm portion of said first closure element being received in locking engagement by the second arm portion of said second closure element.

2. A closure fastening device in accordance with claim 1 wherein said arm portions of said second closure element generally curvilinearly converge toward each other.

3. A closure fastening device in accordance with claim 1 wherein said arm portions of said second closure element are initially outwardly curved.

4. A closure fastening device in accordance with claim 1 wherein said first arm portion of said second closure element is inwardly curved before terminating in said inwardly curved hook portion.

5. A closure fastening device in accordance with claim 1 wherein said second arm portion of said second closure element terminates in an outwardly extending portion.

6. A closure fastening device in accordance with claim 5 wherein said second arm portion of second closure element curves inwardly before terminating in said outwardly extending portion.

7. A closure fastening device in accordance with claim 1 wherein said second arm portion of said second closure element is generally straight and extends generally perpendicular from said apex portion of said second closure element.

8. A closure fastening device in accordance with claim 1 wherein said first closure element and said second closure element are adapted to engage each other by means of a straddling occlusion wherein said second arm portion of said second closure element is positioned between said arm portions of said first closure element.

9. A closure fastening device in accordance with claim 1 wherein said first closure element and said second closure element are adapted to engage each other by means of an overlapping occlusion wherein said second arm portion of said second closure element is positioned outside the arm portion of said first closure element with which it enters into locking engagement.

10. A closure fastening device in accordance with claim 1 wherein said apex portion of said first closure element is arcuate.

11. A closure fastening device in accordance with claim 1 wherein said apex portion of said first closure element is generally flat.

12. A closure fastening device in accordance with claim 1 wherein said outwardly facing hook portions of said first closure element are curvilinear.

13. A closure fastening device in accordance with claim 1 wherein said apex portion of said second closure element is arcuate.

14. A closure fastening device in accordance with claim 1 wherein said apex portion of said second closure element is generally flat.

15. A closure fastening device in accordance with claim 1 wherein said first closure element and said second closure element are made from a thermoplastic material.

16. A closure fastening device in accordance with claim 15 wherein said thermoplastic material is a polyolefin.

17. A closure fastening device in accordance with claim 16 wherein said polyolefin is a mixture of polypropylene and ethylene-propylene-diene monomer elastomer.

18. A closure fastening device in accordance with claim 1 wherein said first closure element and said second closure element are made from a mixture of polypropylene and ethylene-propylene copolymer elastomer.

19. A closure fastening device in accordance with claim 1 wherein said closure fastening device in an occluded position has a height of between about 0.050 to about 0.140 inch as measured from the apex portion of said first closure element to the apex portion of said second closure element.

20. A closure fastening device in accordance with claim 1 wherein said second closure element has a height of between about 0.040 to about 0.100 inch as measured from the apex portion of said second closure element to the tip portion of said second arm portion of said second closure element.

21. A closure fastening device in accordance with claim 1 wherein said first closure element has a height of between about 0.040 to about 0.100 inch as measured from the apex portion of said first closure element to the highest part of the profile portion of said first closure element.

22. A closure fastening device in accordance with claim 1 wherein said second closure element has a width of between about 0.050 to about 0.240 inch as measured from the widest part of said first arm portion of said second closure element to the widest part of said second arm portion of said second closure element.

23. A closure fastening device in accordance with claim 1 wherein said first closure element has a width of between about 0.034 to about 0.224 inch as measured between the tips of said outwardly facing hook portions of said first closure element.

24. A closure fastening device comprising a first closure element and a second closure element; said first closure element having a general omega shape, comprising an apex portion and a profile portion extending from said apex portion, said profile portion comprising two inwardly curved arm portions terminating in two outwardly facing hook portions; said second closure element comprising an apex portion and a profile portion extending from said apex portion, said profile portion comprising first and second arm portions generally curvilinearly converging relative to each other, wherein said first arm portion terminates in an inwardly curved hook portion and said second arm portion terminates in an outwardly extending portion said first and second arm portions of said second closure element being adapted to receive therebetween one arm portion of said first closure element the hook portion of the latter arm being received in hinging engagement under the inwardly curved hook portion of the first arm of said second closure element, the other arm portion of said first closure element being received in straddling, locking engagement by the second arm portion of said second closure element.

25. A closure fastening device in accordance with claim 24 wherein said second arm portion of said second closure element curves inward before terminating in said outwardly extending portion.

26. A closure fastening device in accordance with claim 24 wherein said apex portion of said first closure element is arcuate.

27. A closure fastening device in accordance with claim 24 wherein said apex portion of said first closure element is generally flat.

28. A closure fastening device in accordance with claim 24 wherein said outwardly facing hook portions of said first closure element are curvilinear.

29. A closure fastening device in accordance with claim 24 wherein said apex portion of said second closure element is arcuate.

30. A closure fastening device in accordance with claim 24 wherein said apex portion of said second closure element is generally flat.

31. A closure fastening device in accordance with claim 24 wherein said first closure element and said second closure element are adapted to engage each other by means of a straddling occlusion wherein said second arm portion of said second closure element is positioned between said arm portions of said first closure element.

32. A closure fastening device in accordance with claim 24 wherein said first closure element and said second closure element are made from a thermoplastic material.

33. A closure fastening device in accordance with claim 32 wherein said thermoplastic material is a polyolefin.

34. A closure fastening device in accordance with claim 33 wherein said polyolefin is a mixture of polypropylene and ethylene-propylene-diene monomer elastomer.

35. A closure fastening device in accordance with claim 24 wherein said first closure element and said second closure element are made from a mixture of polypropylene and ethylene-propylene copolymer elastomer.

36. A closure fastening device comprising a first closure element and a second closure element; said first closure element having a general omega shape, comprising an apex portion and a profile portion extending from said apex portion, said profile portion comprising two inwardly curved arm portions terminating in two outwardly facing hook portions; said second closure element comprising an apex portion and a profile portion extending from said apex portion, said profile portion comprising outwardly curved first and second arm portions, wherein said first arm portion terminates in an inwardly curved hook portion and said second arm portion terminates in an outwardly curved portion said first and second arm portions of said second closure element being adapted to receive therebetween one arm portion of aid first closure element the hook portion of the latter arm being received in hinging engagement under the inwardly curved hook portion of the first arm of said second closure element, the other arm portion of said first closure element being received in locking engagement by the second arm portion of said second closure element.

37. A closure fastening device in accordance with claim 36 wherein said apex portion of said first closure element is arcuate.

38. A closure fastening device in accordance with claim 36 wherein said apex portion of said first closure element is generally flat.

39. A closure fastening device in accordance with claim 36 wherein said outwardly facing hook portions of said first closure element are curvilinear.

40. A closure fastening device in accordance with claim 36 wherein said apex portion of said second closure element is arcuate.

41. A closure fastening device in accordance with claim 36 wherein said apex portion of said second closure element is generally flat.

42. A closure fastening device in accordance with claim 36 wherein said second arm portion of said second closure element curves inwardly before terminating in said outwardly curved portion.

43. A closure fastening device in accordance with claim 36 wherein said first closure element and said second closure element are adapted to engage each other by means of an overlapping occlusion.

44. A closure fastening device in accordance with claim 36 wherein said first closure element and said second closure element are made from a thermoplastic material.

45. A closure fastening device in accordance with claim 44 wherein said thermoplastic material is a polyolefin.

46. A closure fastening device in accordance with claim 45 wherein said polyolefin is mixture of polypropylene and ethylene-propylene-diene monomer elastomer.

47. A closure fastening device in accordance with claim 36 wherein said first closure element and said second closure element are made from a mixture of polypropylene and ethylene-propylene copolymer elastomer.

48. A closure fastening device in accordance with claim 36 wherein said closure fastening device in an occluded position has a height of between about 0.050 to about 0.140 inch as measured from the apex portion of said first closure element to the apex portion of said second closure element.

49. A closure fastening device in accordance with claim 36 wherein said second closure element has a height of between about 0.040 to about 0.100 inch as measured from the apex portion of said second closure element to the tip portion of said second arm portion of said second closure element.

50. A closure fastening device in accordance with claim 36 wherein said first closure element has a height of between about 0.040 to about 0.100 inch as measured from the apex portion of said first closure element to the highest part of the profile portion of said first closure element.

51. A closure fastening device in accordance with claim 36 wherein said second closure element has a width of between about 0.050 to about 0.240 inch as measured from the widest part of said first arm portion of said second closure element to the widest part of second arm portion of said second closure element.

52. A closure fastening device in accordance with claim 36 wherein said first closure element has a width of between about 0.034 to about 0.224 inch as measured between the tips of said outwardly facing hook portions of said first closure element.

53. A closure fastening device comprising a first closure element and a second closure element; said first closure element having a general omega shape, comprising an apex portion and a profile portion extending from said apex portion, said profile portion comprising two inwardly curved arm portions, an outwardly extending arm portion from each of said inwardly curved arm portions, each of said outwardly extending arm portions terminating in an outwardly curved hook portion; said second closure element comprising an apex portion and a profile portion extending from said apex portion, said profile portion comprising first and second arm portions, wherein said first arm portion terminates in an inwardly curved hook portion and said second arm portion extends in a generally perpendicular direction from said apex portion said first and second arm portions of said second closure element being adapted to receive therebetween one arm portion of said first closure element the hook portion of the latter arm being received in hinging engagement under the inwardly curved hook portion of the first arm of said second closure element, the other arm portion of said first closure element being received in locking engagement by the second arm portion of said second closure element.

54. A closure fastening device in accordance with claim 53 wherein said apex portion of said first closure element is arcuate.

55. A closure fastening device in accordance with claim 53 wherein said apex portion of said first closure element is generally flat.

56. A closure fastening device in accordance with claim 53 wherein said outwardly facing hook portions of said first closure element are curvilinear.

57. A closure fastening device in accordance with claim 53 wherein said apex portion of said second closure element is arcuate.

58. A closure fastening device in accordance with claim 53 wherein said apex portion of said second closure element is generally flat.

59. A closure fastening device in accordance with claim 53 wherein said first closure element and said second closure element are adapted to engage and disengage each other by means of a hinging action so as to form a straddling occlusion.

60. A closure fastening device in accordance with claim 53 wherein said first closure element and said second closure element are made from a thermoplastic material.

61. A closure fastening device in accordance with claim 60 wherein said thermoplastic material is a polyolefin.

62. A closure fastening device in accordance with claim 61 wherein said polyolefin is a mixture of polypropylene and ethylene-propylene-diene monomer elastomer.

63. A closure fastening device in accordance with claim 53 wherein said first closure element and said second closure element are made from a mixture of polypropylene and ethylene-propylene copolymer elastomer.

64. A closure fastening device in accordance with claim 1 wherein said first closure element and said second closure element are made from a polypropylene copolymer.

65. A closure fastening device in accordance with claim 1 wherein said first closure element and said second closure element are made from a blend of resin materials selected from (a) a polypropylene copolymer and a polypropylene homopolymer, (b) a polypropylene copolymer and a polybutene copolymer, (c) a polypropylene copolymer and an elastomer, and (d) mixtures of (a), (b), and (c).

66. A closure fastening device in accordance with claim 65 wherein said blend of resin materials contains between about 100 ppm and about 2000 ppm of a slip agent selected from fatty acid amides.

67. A closure fastening device in accordance with claim 1 wherein said first closure element and said second closure element are made from a material comprising a blend of from about 85 to about 95 percent by weight of polypropylene homopolymer, and from about 5 to about 15 percent by weight of a poly-1-butene copolymer containing up to about 5 percent by weight of ethylene.

68. A closure fastening device in accordance with claim 1 wherein said first closure element and said second closure element are made from a material comprising a blend of from about 85 to 95 percent by weight of polypropylene homopolymer, and from about 5 to about 15 percent by weight of ethylene-propylene-diene monomer elastomer.

69. A closure fastening device in accordance with claim 1 wherein said first closure element and said second closure element are made from a material comprising a blend of from about 85 to 95 percent by weight of polypropylene homopolymer, and from about 5 to about 15 percent by weight of ethylene acrylate copolymer.

70. A closure fastening device in accordance with claim 1 wherein said first closure element and said second closure element are made from a material comprising a blend of from about 10 to about 50 percent by weight of polypropylene homopolymer, and from about 50 to about 90 percent by weight of a poly(propylene-ethylene) copolymer having a melt flow rate of between about 1.5 and about 8 grams/10 minutes and a flexural modulus of between about 100,000 and about 132,000 psi.

71. A closure fastening device in accordance with claim 1 wherein said first closure element and said second closure element are made from a material comprising a blend of from about 85 to about 95 percent by weight of poly(propylene-ethylene) copolymer, and from about 5 to about 15 percent by weight of a copolymer selected from the group containing of (1) a poly-1-butene copolymer containing up to about 5 percent by weight of ethylene, (2) an ethylene-propylene-diene monomer elastomer, and (3) an ethylene-methyl acrylate copolymer.

72. A closure fastening device in accordance with claim 1 including flange portions attached to said first closure element and said second closure element.

73. A closure fastening device in accordance with claim 72 wherein said flange portions are made from a material comprising a thermoplastic material selected from the group consisting of a polypropylene homopolymer, a poly-1-butene copolymer, an ethylene-propylene-diene monomer elastomer, and an ethylene-methyl acrylate copolymer.

74. A closure fastening device in accordance with claim 72 wherein said flange portions are made from a material comprising a blend of a polypropylene homopolymer and a poly-1-butene copolymer.

75. A closure fastening device in accordance with claim 72 wherein said flange portions are made from a material comprising a blend of from about 85 to about 95 percent by weight of polypropylene homopolymer, and from about 5 to about 15 percent by weight of a poly-1-butene copolymer containing up to about 5 percent by weight of ethylene.

76. A closure fastening device in accordance with claim 72 wherein said flange portions are made from a material comprising a blend of from about 85 to about 95 percent by weight of polypropylene homopolymer, and from about 5 to about 15 percent by weight of a material selected from the group consisting of ethylene-propylene-diene monomer elastomer, ethylene-methyl acrylate copolymer, and mixtures thereof.

77. A closure fastening device comprising a first closure element and a second closure element adapted to interlock by pressing said first closure element into said second closure element, wherein said closure fastening device is made from a thermoplastic material comprising a polypropylene polymer.

78. A closure fastening device in accordance with claim 77 wherein said polypropylene polymer is a homopolymer.

79. A closure fastening device in accordance with claim 77 wherein said polypropylene polymer is a copolymer.

80. A closure fastening device in accordance with claim 77 wherein said polypropylene polymer is selected from the group consisting of polypropylene homopolymers and polypropylene copolymers, and blends thereof.

81. A closure fastening device in accordance with claim 77 wherein said thermoplastic material comprises said polypropylene polymer and a polybutene copolymer.

82. A closure fastening device in accordance with claim 77 wherein said thermoplastic material comprises said polypropylene polymer and an elastomer.

83. A closure fastening device in accordance with claim 77 wherein said thermoplastic material contains between about 100 ppm and about 2000 ppm of a slip agent selected from fatty acid amides.

84. A closure fastening device in accordance with claim 77 wherein said thermoplastic material comprises said polypropylene polymer and an ethylene propylene-diene monomer elastomer.

85. A closure fastening device in accordance with claim 77 wherein said thermoplastic material comprises said polypropylene polymer and an ethylene-methyl acrylate copolymer.

86. A closure fastening device in accordance with claim 77 wherein said thermoplastic material comprises said polypropylene polymer and a poly(propylene-ethylene) copolymer.

87. A closure fastening device in accordance with claim 77 wherein said thermoplastic material comprises a blend of poly(propylene-ethylene) copolymer and a resin selected from the group consisting of (a) a poly-1-butene copolymer, (b) an ethylene-propylene-diene monomer elastomer, and (c) an ethylene-methyl acrylate copolymer.

* * * * *